US011192165B2

(12) United States Patent
Fröhlich et al.

(10) Patent No.: US 11,192,165 B2
(45) Date of Patent: Dec. 7, 2021

(54) METHOD FOR MANUFACTURING A COMPLEX-FORMED COMPONENT

(71) Applicant: Outokumpu Oyj, Helsinki (FI)

(72) Inventors: Thomas Fröhlich, Ratingen (DE); Stefan Lindner, Willich (DE)

(73) Assignee: Outokumpu Oyj, Helsinki (FI)

( * ) Notice: Subject to any disclaimer, the term of this patent is extended or adjusted under 35 U.S.C. 154(b) by 170 days.

(21) Appl. No.: 16/463,139

(22) PCT Filed: Nov. 22, 2017

(86) PCT No.: PCT/EP2017/080115

§ 371 (c)(1),
(2) Date: May 22, 2019

(87) PCT Pub. No.: WO2018/095993

PCT Pub. Date: May 31, 2018

(65) Prior Publication Data

US 2020/0061690 A1 Feb. 27, 2020

(30) Foreign Application Priority Data

Nov. 23, 2016 (EP) ..... 16200246

(51) Int. Cl.

| | |
|---|---|
| ***C21D 7/06*** | (2006.01) |
| ***B21D 22/28*** | (2006.01) |
| ***C23C 8/46*** | (2006.01) |
| ***C23C 8/50*** | (2006.01) |

(52) U.S. Cl.

CPC ..... *B21D 22/28* (2013.01); *C21D 7/06* (2013.01); *C23C 8/46* (2013.01); *C23C 8/50* (2013.01)

(58) Field of Classification Search

CPC .. B21D 22/28; C23C 8/46; C23C 8/50; C21D 7/06; C21D 6/002; C21D 9/0436

See application file for complete search history.

(56) References Cited

U.S. PATENT DOCUMENTS

| | | | | |
|---|---|---|---|---|
| 4,217,136 | A | 8/1980 | Hartline, III | |
| 4,514,236 | A * | 4/1985 | Cook | C22C 38/08 148/609 |
| 5,593,510 | A * | 1/1997 | Tahara | C23C 8/34 148/225 |
| 10,000,822 | B2 | 6/2018 | Schiebol | |
| 2004/0231762 | A1 | 11/2004 | Steinhofer et al. | |
| 2008/0083477 | A1* | 4/2008 | Drillet | C23C 2/02 148/242 |
| 2010/0258218 | A1 | 10/2010 | Hong et al. | |
| 2013/0209833 | A1* | 8/2013 | Scott | B32B 15/013 428/659 |
| 2015/0376749 | A1 | 12/2015 | Fröhlich et al. | |

FOREIGN PATENT DOCUMENTS

| | | | |
|---|---|---|---|
| DE | 19607828 | A1 | 10/1996 |
| DE | 102012222670 | A1 | 6/2013 |
| EP | 2090668 | A1 | 8/2009 |
| WO | 2015028406 | A1 | 3/2015 |

* cited by examiner

*Primary Examiner* — Jessee R Roe
(74) *Attorney, Agent, or Firm* — The Webb Law Firm

(57) ABSTRACT

The present invention relates to a method for manufacturing a complex-formed component by using austenitic steels in a multi-stage process where cold forming and heating are alternated for at least two multi-stage process steps. The material during every process step and a component produced has an austenitic microstructure with non-magnetic reversible properties.

24 Claims, 4 Drawing Sheets

METHOD FOR MANUFACTURING A COMPLEX-FORMED COMPONENT

CROSS REFERENCE TO RELATED APPLICATIONS

This application is the United States national phase of International Application No. PCT/EP2017/080115 filed Nov. 22, 2017, and claims priority to European Patent Application No. 16200246.3 filed Nov. 23, 2016, the disclosures of which are hereby incorporated by reference in their entirety.

BACKGROUND OF THE INVENTION

Field of the Invention

The present invention relates to a method for manufacturing a multi-stage forming operation by very complex parts with austenitic materials by a combination of cold forming and annealing treatments. During the forming operation, the formation of twins have been achieved in austenitic materials ductility diminishes.

Description of Related Art

In car body engineering components with a complex forming geometry are manufactured with soft deep drawing steels. There are requirements to fulfil a higher strength lightweight, package or safety targets, available high strength steels like dual-phase steels, multi-phase steels or complex phase steels reach their limit of formability very often. The defined-adjusted mechanical values and microstructure parts (during steel-manufacturing) react sensitive to following forming or heat treatment steps during component manufacturing. Therefore they change undesirably their properties.

One solution are hot-forming operations like the so-called press-hardening, where heat-treatable manganese-boron steels are heated up to austenitization temperature (over 900° C.), through hardening for a specific holding time and then formed at those high temperatures in a hot-forming tool to the resulting component. At the same time of the forming operation, the heat is discharged from the sheet to the contact areas of the tool and therefore cooled-down. The process is described for example in the US20040231762A1. With the process of hot-forming, complex parts can be realized by using a high-strength material. But the residual elongation is on a lowest level (most of the time <5%).

Therefore following cold forming steps are not possible as well as high energy absorption during a crash situation of a car body component. Furthermore not at any time, a tensile strength of 1,500 MPa is requested, for example when the system becomes too stiff. Additionally the investment, repair and energy costs as well as the necessary room for the roller head furnaces are very high with marginal cycle times in comparison to cold forming operations. Moreover the corrosion protection is on a lower level in comparison to coated cold-forming steels.

For a lot of decades austenitic stainless steels are used in the application field of domestic goods for complex cold forming parts like sinks. The established materials are alloyed with chromium and nickel by using the hardening effect of TRIP (TRansformation Induced Plasticity) where the metastable austenitic microstructure is changed into martensite during a forming load. At room temperature the austenitic microstructure is stable because of the lower martensitic starting temperature. In the literature this effect is well-known as "deformation induced martensite formation". A drawback of using these materials for complex cold-forming operations is that the formally austenitic material changes the properties to a martensitic microstructure with lower ductility, increasing of hardness and therefore a decrease of the resulting energy absorption potential. Furthermore the process is not reversible. The advantages of an austenitic material like the nonmagnetic properties get loss and cannot be used in the component situation of the material. The irreversible microstructure change is a big drawback for complex multi-staged forming operations where the residual elongation is insufficient. Furthermore the effect of TRIP is sensitive to temperature which results in a further investment need for tool cooling. Moreover those materials show the danger of stress induced delayed cracking when changing their microstructure during a forming process to martensite. The stacking fault energy of those materials with TRIP-effect is lower than SFE <20 mJ/m$^2$. Additionally the danger of hydrogen embrittlement is given by the martensite transformation.

The described austenitic stainless steels with TRIP effect are in initial state nonmagnetic. The publication DE102012222670A1 describes a method for the local heating of components manufactured by stainless steels using the TRIP effect and the out of this effect rising forming martensite. Furthermore equipment for inductive heating of austenitic stainless steels with martensite transformation is created by a recrystallization locally in the martensite areas of the component.

The publication WO2015028406A1 describes a method to harden a metal sheet, whereat by shot peening or grit blasting the surface is hardened. As a result the surface is more scratch-resistant for sink applications. Especially the usage of metastable chromium-nickel alloyed 1.4301 is pointed out.

SUMMARY OF THE INVENTION

The object of the present invention is to eliminate some drawbacks of the prior art and to establish a method for manufacturing of a complex-formed component of austenitic steel having non-magnetic properties at the end and during all process steps. The multistage process with a combination of forming and heating results in reversible material properties, which is achieved by TWIP hardening effect and the stable austenitic microstructure. The essential features of the present invention are enlisted in the appended claims.

The steel used in the invention contains interstitial disengaged nitrogen and carbon atoms so that the sum of the carbon content and the nitrogen content (C+N) is at least 0.4 weight %, but less than 1.2 weight %, and the steel advantageously can also contain more than 10.5 weight % chromium, being thus an austenitic stainless steel. Another ferrite former like chromium is silicium, which works as a deoxidizer during steel manufacturing. Further silicium increase the strength and hardness of the material. In the present invention the silicium content of the steel is less than 3.0 weight-% to restrict hot-crack-affinity during welding, more preferably less than 0.6 weight-% to avoid the saturation as a deoxidizer, further more preferably less than 0.3 weight-% to avoid low-melting phases on Fe—SI basis and to restrict an undesirable decrease of the stacking fault energy. In case the steel contains essential contents of at least one ferrite phase former, such as chromium or silicium, a compensation with the contents of the austenite phase formers like carbon or nitrogen, but also such as manganese weight-% is between 10% and less than or equal to 26%, preferably between 12-16%, carbon and nitrogen both weight % values are more than 0.2% and less than 0.8%, nickel weight % is equal or less than 2.5%, preferably less than 1.0%, or copper weight % is less or equal than 0.8%, preferably between 0.25-0.55% will be done in order to have a balanced and sole content of austenite in the microstructure of the steel.

The present invention exists in that complex forming parts can be realized with a multi-staged cold forming and heating operation under retention or optimization of the austenitic material properties after finishing the forming operation.

The forming steps of the multi-staged process are carried out by hydro-mechanical deep-drawing processes like sheet-hydroforming or internal high-pressure forming.

Furthermore the forming steps of the multi-staged process are carried out by deep-drawing, pressing, plunging, bulging, bending, spinning or stretch forming.

According to the present invention an austenitic steel with an elongation $A_{80}$ is equal or more than 50% is used in a multi-staged forming process, whereby the material is characterized by a TWIP (Twinning induced Plasticity) hardening effect, a specific adjusted stacking fault energy between 20 more than or equal SFE less than or equal 30 mJ/m$^2$, preferably 22-24 mJ/m$^2$ and therefore stable austenitic microstructure as well as stable nonmagnetic properties during the complete forming process.

The invention relates to a method for a multi-stage forming operation, where forming and heating are consisting by two different steps of operation, where multi-stage metal-forming process includes at least two different (or independent from each other) steps where at least one step is a forming step. The other can be a further forming step or for example a heat treatment. Furthermore in the invention is described a subsequent process which includes forming and heating for creating complex formed parts and which uses to reach this target an austenitic (stainless) steel with TWIP hardening effect with its specific properties and possibilities for complex forming parts manufactured out of austenitic steel with utilization of the TWIP (Twinning Induced Plasticity) hardening effect. During heating the twins in the microstructure of the used TWIP material are dissolved and during forming the twins in the microstructure of the used TWIP material are rebuilt.

Complex formed parts in state of the art for the sheet fabricating industry are white goods, consumer goods or car body engineering. Furthermore the extensive-designed and complex forming geometries have the benefit of saving number of parts, or integrating additional functions. A multi-staged complex-formed component as a white good can be found like a kitchen sink or bathes in domestic appliances like a drum of a dish washer or washing machine. Furthermore functional or constructive requirements like package limitations e.g. longitudinal member of a car or volume specifications such as tanks, reservoirs are also suitable for a complex constructive configuration. Additionally design aspects e.g. sink or load path of crash structures such as crash box with bumper systems for cars can be further solutions to the method of invention. Furthermore the invention is suitable for hang-on parts of transportation systems, like complex-formed doors or door-side impact beams, as well as for interior parts like seat structures especially seat back walls. The component deformed according to the present invention can be applied for transport systems, such as cars, trucks, busses, railway or agricultural vehicles, as well as for automotive industry like an airbag sleeve or an fuel filler pipe.

The multistage forming operation is an alternating process of cold forming e.g. lower than 100° C. and not under −20° C., but preferably at room temperature and following short-time heating. The number of process steps depends on the forming complexity.

BRIEF DESCRIPTION OF THE DRAWINGS

The present invention is illustrated in more details referring to the attached drawings where.

DESCRIPTION OF THE INVENTION

Figure 1:
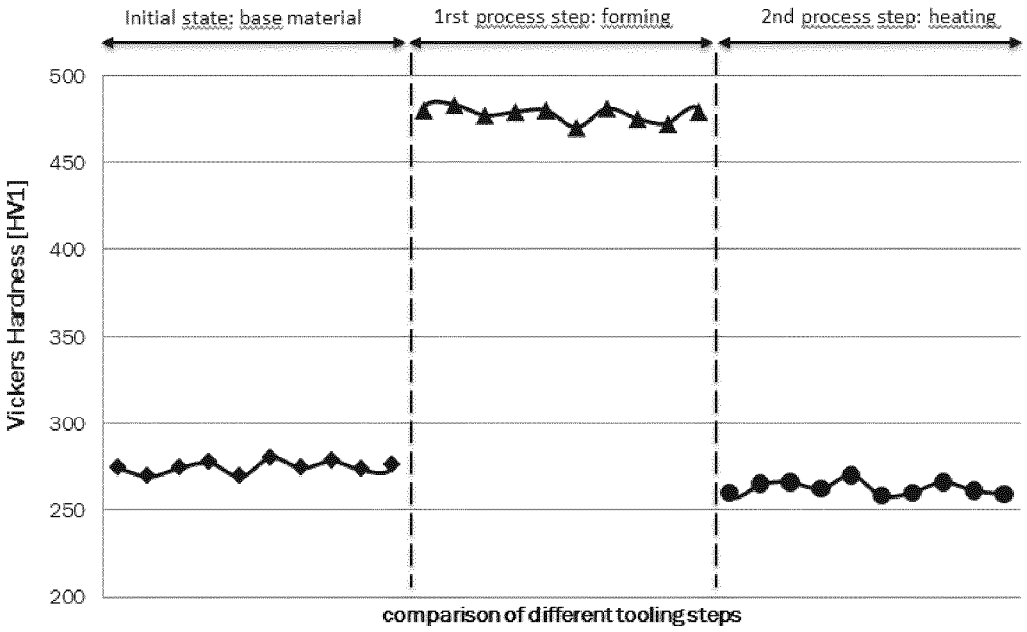
FIG. 1 shows hardness-comparison of different process.

FIG. 1 shows the result of a hardness measured component after such a forming and heating operation. Hardness-comparison of different process steps of the multi-staged forming operation: Initial, base material (left), after first forming step with a forming degree of 20% (middle) and after heating process (right); for every state 10 hardness point per measured.

Figure 2:
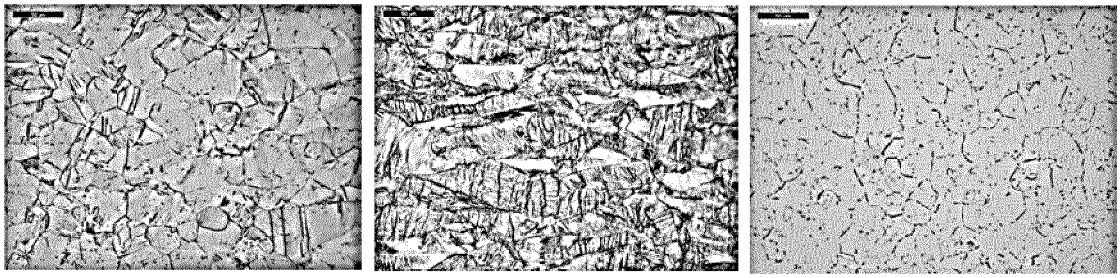
FIG. 2 shows the formation of twins as a metallographic inspection.

In FIG. 2 the formation of twins is shown as a metallographic inspection in FIG. 2, related to the hardness measurement in FIG. 1.

Figure 3:
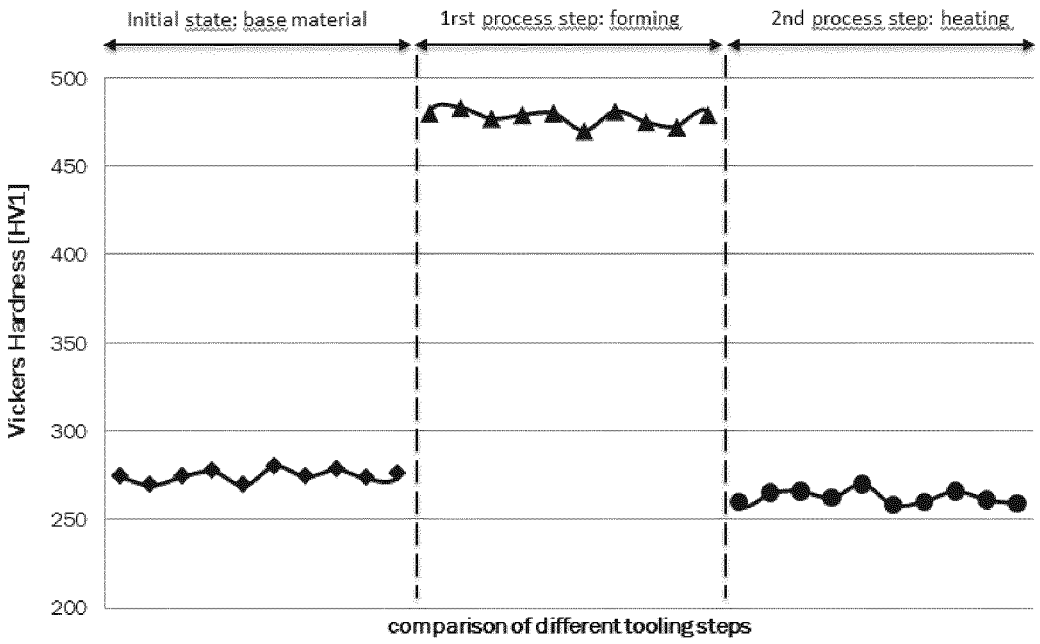
FIG. 3 shows forming degree diagram of a an austenitic TWIP steel.

FIG. 3 shows the forming degree diagram of austenitic TWIP steel with 12-17% of chromium and manganese.

Figure 4:
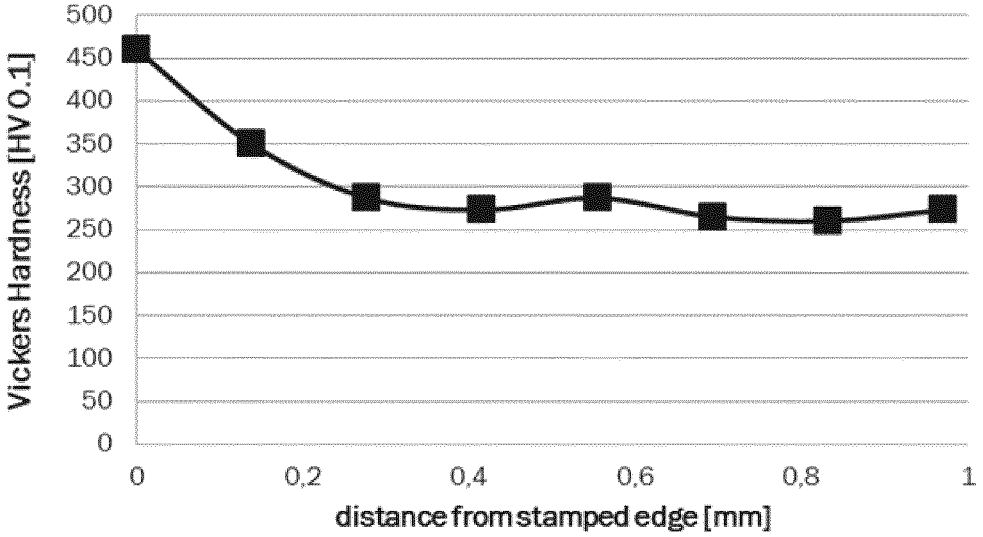
FIG. 4 shows effect of hardening from a stamped edge.

In FIG. 4 is shown the effect of hardening from a stamped edge for a 12-17% chromium and manganese alloyed TWIP steel.

Figure 5:
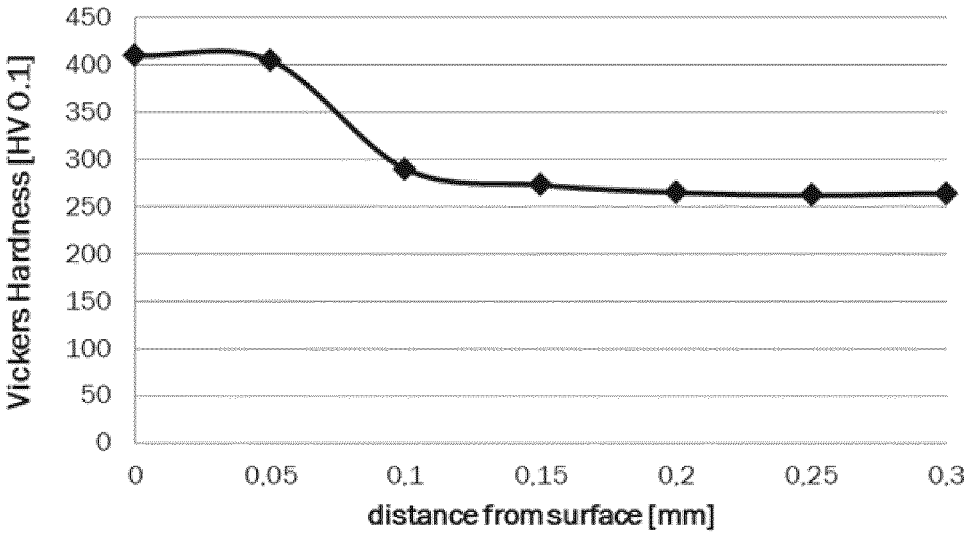
FIG. 5 shows effect of surface hardening by shot peening.

FIG. 5 shows the effect of surface hardening by shot peening on full-austenitic TWIP steel.

Figure 6:
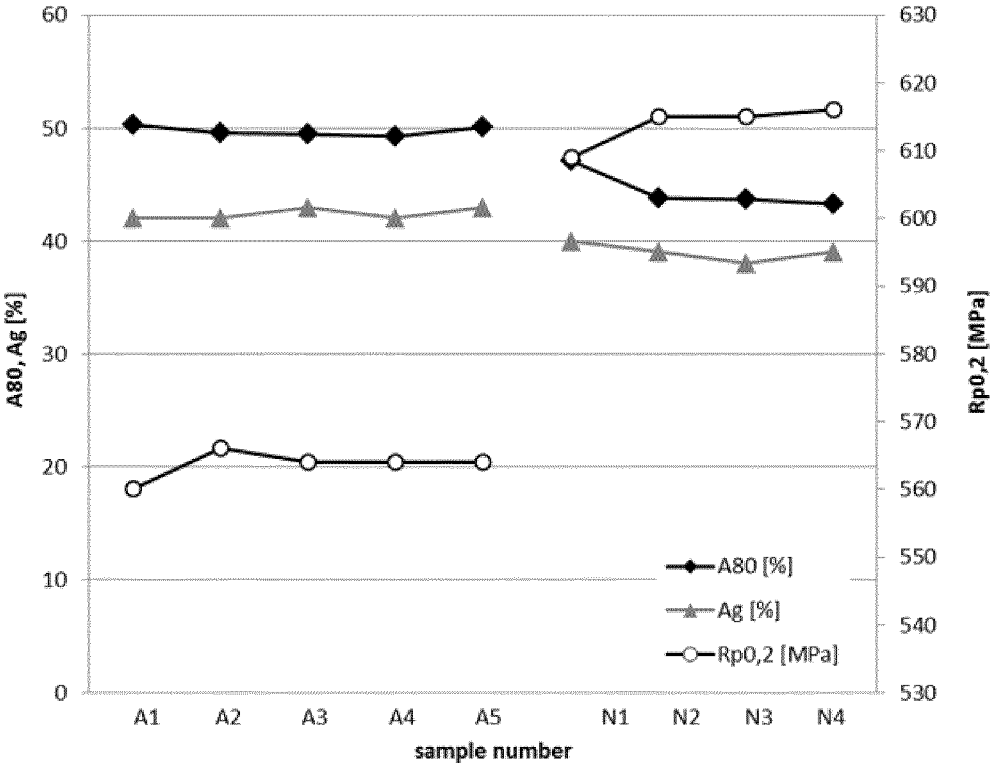
FIG. 6 shows effect of surface nitriding heat treatment on the mechanical properties of an austenitic TWIP steel.

In FIG. 6 is shown the effect of surface nitriding heat treatment on the mechanical properties of an austenitic TWIP steel in annealed condition $R_{p0,2}$=yield strength, $A_{80}$=elongation after fracture, $A_g$=uniform elongation, sample definition: A=sampled in initial annealed condition, N=sample after nitriding treatment.

Figure 7:
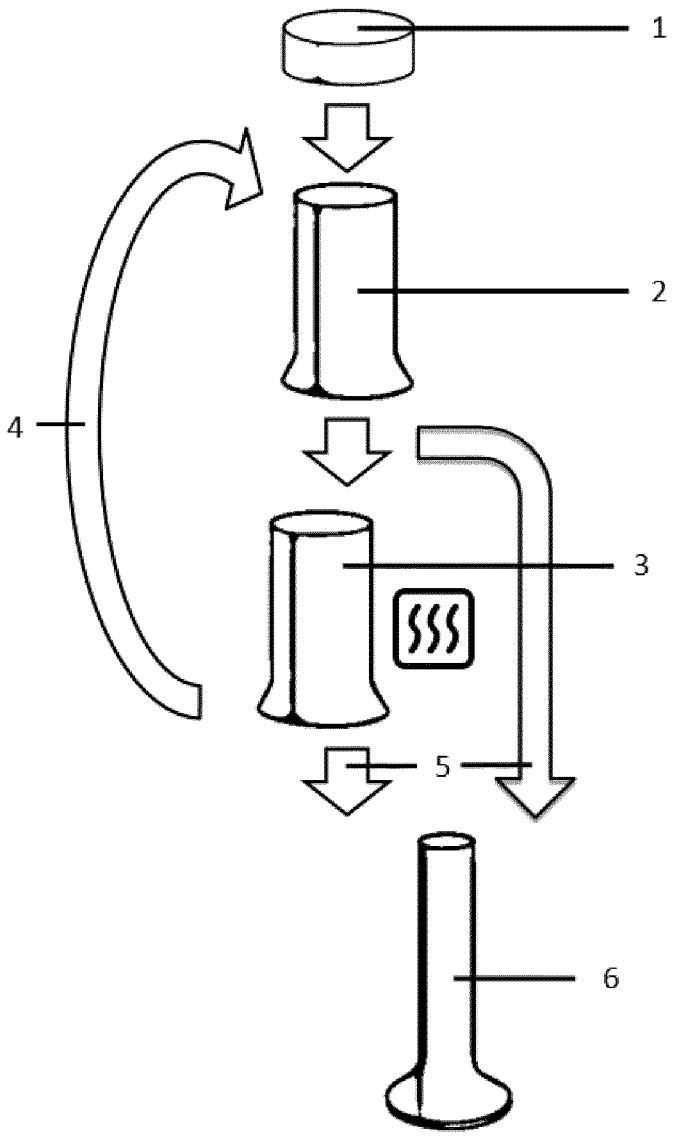
FIG. 7 shows a multi-stage metal-forming process.

In FIG. 7 a multi-stage metal-forming process consists of different heating and forming steps with utilization of the TWIP hardening effect.

The material used in the method will be hardened during the forming operation because of the TWIP effect, but the material will maintain the austenitic microstructure. For an austenitic TWIP material the forming degree shall be less than or equal to 60%, preferably less than or equal to 40%. If the forming potential, defined by the forming degree of the material is at the end of the method or if high tooling forces for forming are required, the second step, a heating step can be started. During the following heating step, the twins are dissolved and the material will be softened again. Because of the before defined material characteristics, the method is a reversible process. The heating process can be integrated into one forming tool with induction or conduction. The heating temperature must be between 750 and 1150° C., preferably between 900 and 1050° C. The process can be repeated as many times as required to establish the desired complex geometry.

The initial thickness of the sheet used for the multi-staged process shall be less than 3.0 mm, preferably between 0.25 and 1.5 mm. It is also possible to use flexible rolled sheets with the present invention, too.

The component is in the form of a sheet, a tube, a profile, a wire or a joining rivet.

The formations of twins are shown as a metallographic inspection in FIG. 2, related to the hardness measurement in FIG. 1. The formation of twins by forming and dissolving by heating can be pointed out very well. With a further forming step after heating, the formation of twins is restarted again and the component will be hardened again. This process can be used alternated and repeated as many times as required to reach the geometry as well as target mechanical values for strength and elongation. Therefore the last step of the multi-staged forming operation can be a forming step with a defined forming degree as well as a locally heating step. For the use of a TWIP-steel which is alloyed with 12-17% of chromium as well as manganese, the forming diagram is used to adjust the sufficient values of the finished component, FIG. 3. As seen in FIG. 3, the invention is especially suitable for high or ultra-high strength steels having a minimum yield strength level more or equal than 500 MPa. The heating steps can be designed with induction, conduction or also infrared technology. Heating-up rates of 20K/s are possible and do not influence the behavior of the twins.

Additionally forming operations can be integrated to the forming tool. As a result the hardening effect for state of the art operations can be reached over 160% of the base material. This drawback of edge hardening can be solved also by a following heating step. As a result the edge crack sensitive can be reduced significantly.

A further positive aspect of the invention is the possibility to create a compressive stress value on the surface by an upset forming operation such as shot peening, grit blasting or high frequency pounding to reduce edge crack or surface crack sensitivity as well as a better fatigue behavior when the multi-stage formed component is under fatigue stressed conditions e.g. automotive component. Such surface treatment is in general well-known but the combination with the pointed out material characteristic shows new properties because the microstructure and therefore the material properties (e.g. non-magnetic) will be constant. The combination of process and material results in the values are shown in table 1, where the effect of surface hardening (shot peening) and subsequent heat treatment are on the residual stress level of full-austenitic TWIP steels.

TABLE 1

| | | Residual stresses on the surface [MPa] | | |
|---|---|---|---|---|
| material | Yield strength [MPa] | Initial state | After shot peening | After an subsequent heat treament |
| TWIP steel annealed condition | 515 | 28 | −811 | −560 |
| TWIP steel strain hardened | 811 | 102 | −889 | −589 |

In table 1, a plus sign means tensile stresses on the surface; a minus sign means a compressive stress level.

The general deviation of the measuring method can be +/−30 MPa. It can be shown with table 1. that the material stresses in initial state, especially for the strain hardened cold-rolled variants, can be transferred by an upset forming operation into uncritical compressive values. Such an operation can be also integrated into the multi-stage forming process because a high compressive load level can be also maintained after a subsequent heat treatment.

A multi-staged complex-formed component can be used as an automotive component, like a wheel-house, bumper system, channel or as a chassis component e.g. suspension arm. Furthermore a multi-staged complex-formed component as a mounting part can be used in transportation systems like a door, a flap, a flender beam or a load-bearing flank, a interior part of a transport system like a seat structure component e.g. seat backrest.

There are also possibilities to create a multi-staged complex-formed component as a part of a fuel injection system like a filler neck or as a tank or storage for cars, trucks, transport systems, railway, agricultural vehicles as well as for automotive industry, and further in building and a pressure vessel or boiler or to be used of a multi-staged complex-formed component as battery electric vehicles or hybrid cars like a battery case.

An additional surface effect like an upset forming operation can be reached with a nitriding or carburizing heat treatment. Both elements, nitrogen and carbon, operate as austenite formers and therefore this elements stabilize the local stacking fault energy and the resulting hardening effect, TWIP mechanism. The effect of nitriding or carburizing is in a hardening of the near surface structure of the component as shown in FIG. 5. Furthermore, the near surface structure influence for the mechanical values of the TWIP steel, represent as shown the mechanical values in FIG. 6.

A nitriding or carburizing surface treatment with a heating temperature between 500 and 650° C., preferably between 525 and 575° C., is integrated into the multi-staged process to create a scratch-resistance and at the same time non-magnetic surface of the component.

A multi-stage metal-forming process can be seen in FIG. 7, which includes a sheet, plate, tube 1 at least two different (or independent from each other) steps where at least one step is a forming step 2. The next step 3 is heat treatment. The number of multi-stage process 4 steps depends on the forming complexity 5. As a final result of the method is a complex-formed component 6.

The invention claimed is:

1. A method for manufacturing a complex-formed component, comprising:

subjecting austenitic steel to a multi-stage process where cold forming steps and heating steps are alternated for at least two multi-stage process steps, wherein the cold forming steps of the multi-stage process are carried out by deep-drawing, plunging, bulging, bending, spinning, stretch forming, or a hydro-mechanical deep-drawing process, the austenitic steel maintains an austenitic microstructure with non-magnetic reversible properties during every process step and the component produced has an austenitic microstructure with non-magnetic reversible properties, the austenitic steel is a stable full-austenitic steel exhibiting a twinning induced plasticity (TWIP) hardening mechanism with a defined stacking fault energy of 20-30 mJ/m$^2$, the austenitic steel has an initial elongation of $A_{80}$ that is greater than or equal to 30%, and the heating temperature of the heating steps is 750-1150° C.

2. The method according to claim 1, wherein during heating, twins in the microstructure of the austenitic steel are dissolved, and during forming, the twins in the microstructure of the austenitic steel are rebuilt.

3. The method according to claim 1, wherein the austenitic steel is a sheet having an initial thickness of less than 3.0 mm.

4. The method according to claim 1, wherein a sum of the carbon and nitrogen in the austenitic steel is 0.4-1.2 weight %.

5. The method according to claim 1, wherein the component is in the form of a sheet, a tube, a profile, a wire or a joining rivet.

6. The method according to claim 1, wherein the austenitic steel has a manganese content of 10-26 weight %.

7. The method according to claim 1, wherein the austenitic steel is a stainless steel with more than 10.5 weight % chromium.

8. The method according to claim 1, wherein the heating steps of the multi-staged process are carried out by induction heating, conduction heating or infrared heating.

9. The method according to claim 1, wherein a forming process is integrated into the multi-staged process as a non-final step before a subsequent heating step.

10. The method according to claim 1, wherein an upset forming treatment on the surface is integrated into the multi-staged process to create a scratch-resistant and compressive-loaded surface of the component which is also non-magnetic.

11. The method according to claim 1, wherein a nitriding or carburizing surface heat treatment with a heating temperature between 500 and 650° C. is integrated into the multi-staged process to create a scratch-resistance and non-magnetic surface of the component.

12. The method according to claim 1, wherein the component is a white good appliance, a domestic appliance, an automotive component, a mounting part for a transportation system, a part of a fuel injection system, or a battery case.

13. A method for manufacturing a complex-formed component, comprising:

subjecting austenitic steel to a multi-stage process where cold forming steps and heating steps are alternated for at least two multi-stage process steps, wherein the austenitic steel maintains an austenitic microstructure with non-magnetic reversible properties during every process step and the component produced has an austenitic microstructure with non-magnetic reversible properties, the austenitic steel is a stable full-austenitic steel exhibiting a twinning induced plasticity (TWIP) hardening mechanism with a defined stacking fault energy of 20-30 $mJ/m^2$, the austenitic steel is a stainless steel with more than 10.5 weight % chromium, the austenitic steel has an initial elongation of $A_{80}$ that is greater than or equal to 30%, and the heating temperature of the heating steps is 750-1150° C.

14. The method according to claim 13, wherein during heating, twins in the microstructure of the austenitic steel are dissolved, and during forming, the twins in the microstructure of the austenitic steel are rebuilt.

15. The method according to claim 13, wherein the austenitic steel is a sheet having an initial thickness of less than 3.0 mm.

16. The method according to claim 13, wherein a sum of the carbon and nitrogen in the austenitic steel is 0.4-1.2 weight %.

17. The method according to claim 13, wherein the component is in the form of a sheet, a tube, a profile, a wire, or a joining rivet.

18. The method according to claim 13, wherein the austenitic steel has a manganese content of 10-26 weight %.

19. The method according to claim 13, wherein the forming steps of the multi-staged process are carried out by deep-drawing, pressing, plunging, bulging, bending, spinning, stretch forming, or a hydro-mechanical deep-drawing process.

20. The method according to claim 13, wherein the heating steps of the multi-staged process are carried out by induction heating, conduction heating, or infrared heating.

21. The method according to claim 13, wherein a forming process is integrated into the multi-staged process as a non-final step before a subsequent heating step.

22. The method according to claim 13, wherein an upset forming treatment on the surface is integrated into the multi-staged process to create a compressive-loaded surface of the component which is also non-magnetic.

23. The method according to claim 13, wherein a nitriding or carburizing surface heat treatment with a heating temperature between 500 and 650° C. is integrated into the multi-staged process to create a scratch-resistance and non-magnetic surface of the component.

24. The method according to claim 13, wherein the component is a white good appliance, a domestic appliance, an automotive component, a mounting part for a transportation system, a part of a fuel injection system, or a battery case.

* * * * *